US009758908B2

(12) United States Patent
Le Costaouec et al.

(10) Patent No.: US 9,758,908 B2
(45) Date of Patent: Sep. 12, 2017

(54) SYSTEM AND METHOD FOR PREPARING TEXTILES WITH VOLUMIZED TOWS FOR FACILITATING DENSIFICATION

(71) Applicant: GOODRICH CORPORATION, Charlotte, NC (US)

(72) Inventors: Jean-Francois Le Costaouec, Pueblo West, CO (US); Paul Perea, Pueblo West, CO (US)

(73) Assignee: GOODRICH CORPORATION, Charlotte, NC (US)

( * ) Notice: Subject to any disclaimer, the term of this patent is extended or adjusted under 35 U.S.C. 154(b) by 445 days.

(21) Appl. No.: 14/531,703

(22) Filed: Nov. 3, 2014

(65) Prior Publication Data

US 2016/0122922 A1 May 5, 2016

(51) Int. Cl.
*D02J 1/16* (2006.01)
*D02J 1/18* (2006.01)
(Continued)

(52) U.S. Cl.
CPC ..... *D04H 1/46* (2013.01); *D02G 1/16* (2013.01); *D02J 1/16* (2013.01); *D02J 1/18* (2013.01); *D03D 37/00* (2013.01); *D04H 3/002* (2013.01); *D04H 3/02* (2013.01); *D04H 3/105* (2013.01); *D04H 18/00* (2013.01)

(58) Field of Classification Search
CPC ..... D02J 1/18; D02J 1/02; D02J 1/16; D02J 1/20; D02J 1/22; D02J 1/229; D01D 11/02; D04H 1/46; D04H 3/105; D04H 18/02; D04H 3/02; D04H 3/002; D04H 18/00;
(Continued)

(56) References Cited

U.S. PATENT DOCUMENTS 2,852,906 A * 9/1958 Breen ..... D02G 1/16 28/272
3,156,016 A * 11/1964 Dunlap ..... D02J 1/18 156/166
(Continued)

FOREIGN PATENT DOCUMENTS

EP 2937197 10/2015
EP 2955260 12/2015
(Continued)

OTHER PUBLICATIONS

Extended European Search Report dated Mar. 10, 2016 in European Application No. 15192782.9.

*Primary Examiner* — Amy Vanatta
(74) *Attorney, Agent, or Firm* — Snell & Wilmer, L.L.P.

(57) ABSTRACT

A transport of carbon fiber bundles, in as fabricated carbon fiber tow form, with in-line manipulation of the fiber bundles (spreading or spreading and volumization with manipulators) during fiber bundle transport is described herein. A method including positively transporting and placing a fiber bundle via a moveable fiber bundle delivery mechanism interposed between a fiber bundle supply and a fiber bundle delivery location, manipulating at least one of a fiber volume and an areal weight of the fiber bundle via an air jet device coupled between the fiber bundle delivery location and the fiber bundle supply, and controlling delivery of the fiber bundle tension from the fiber supply through an electronic unwinder is also described.

14 Claims, 6 Drawing Sheets

(51) Int. Cl.

| | |
|---|---|
| ***D02G 1/16*** | (2006.01) |
| ***D04H 1/46*** | (2012.01) |
| ***D04H 3/002*** | (2012.01) |
| ***D04H 3/105*** | (2012.01) |
| ***D04H 18/00*** | (2012.01) |
| ***D04H 3/02*** | (2006.01) |
| ***D03D 37/00*** | (2006.01) |

(58) Field of Classification Search
CPC ..... D02G 1/16; D02G 1/161; D02G 1/165; D02G 1/167; D03D 37/00
USPC ..... 28/107, 112, 283
See application file for complete search history.

(56) References Cited

U.S. PATENT DOCUMENTS 3,328,850 A * 7/1967 Watson ..... D02G 3/06 19/65 T
3,523,059 A * 8/1970 Coates ..... D02G 3/06 156/148
5,008,992 A * 4/1991 Gehrmann ..... D02G 1/0266 28/252
6,032,342 A * 3/2000 Kawabe ..... D01G 9/08 226/97.4
6,253,431 B1 * 7/2001 Ames ..... D02G 1/122 19/66 T
6,836,939 B2 * 1/2005 Guirman ..... D02J 1/18 28/282
7,185,404 B2 * 3/2007 Delecroix ..... D04H 1/498 28/101
7,571,425 B2 * 8/2009 Lessly ..... G06F 8/38 717/104
8,381,376 B2 * 2/2013 Halstead ..... D04H 1/4242 28/103
2006/0090314 A1 5/2006 Delecroix
2011/0275266 A1 11/2011 Le Costaouec
2012/0135227 A1 * 5/2012 Kawabe ..... C08J 5/043 428/338

FOREIGN PATENT DOCUMENTS

JP 2002088640 3/2002
WO WO 03/004744 A1 * 1/2003

* cited by examiner

SYSTEM AND METHOD FOR PREPARING TEXTILES WITH VOLUMIZED TOWS FOR FACILITATING DENSIFICATION

FIELD

This disclosure generally relates to transport, positioning and volumizing a textile, and more particularly, to systems and methods for transport, positioning and volumizing a textile utilizing an air jet device.

BACKGROUND

Carbon/carbon ("C/C") parts are employed in various industries. An exemplary use for C/C parts includes using them as friction disks such as aircraft brake disks, race car brake disks, clutch disks, and the like. C/C brake disks are especially useful in such applications because of the superior high temperature characteristics of C/C material. In particular, the C/C material used in C/C parts is a good conductor of heat and thus is able to dissipate heat away from the braking surfaces that is generated in response to braking C/C material is also highly resistant to heat damage, and is thus capable of sustaining friction between brake surfaces during severe braking, without a significant reduction in the friction coefficient or mechanical failure.

A circular needle loom (CNL) may be utilized to form a circular preform, for example, for use in creating net shape carbon brake disks. Various textile technologies exist for fabricating a continuous carbon feed form for a circular needle loom, including yarn placement, stitch bonding, pre-needling, and loom weaving with conical take-up rolls.

SUMMARY

According to various embodiments an air treatment system of a fiber bundle comprising a supply of the fiber bundle, wherein the fiber bundle comprises at least one of a fiber entering in a carbon/carbon or a ceramic composite. An air jet device may be coupled between the supply of the fiber bundle and a desired lay down location. The air jet device is configured to alter at least one of a fiber volume or an areal weight of the fiber bundle. The air jet device is configured to form a length of volumized fiber bundle. A textile may be fabricated from the length of volumized fiber bundle via a fabrication process at the desired lay down location. The fabrication process comprises at least one of a fabric weaving loom, a multi-axial warp knitting apparatus, or a positive delivery fiber placement fabrication process.

According to various embodiments, a method of fabricating a textile is disclosed herein. The method may include transporting a fiber bundle from a fiber bundle supply to a desired lay down location. The fiber bundle may comprise at least one of a fiber entering a carbon/carbon or a ceramic composite. The method may include altering at least one of a fiber volume or an areal weight of the fiber bundle via an air jet device coupled between the fiber bundle supply and the desired lay down location. The method may include forming a length of volumized fiber bundle via the altering. The method may include fabricating a textile from the length of volumized fiber bundle via a fabrication process at the desired lay down location, wherein the fabrication process comprises at least one of a fabric weaving, multi-axial warp knitting, or a positive delivery fiber placement fabrication process.

BRIEF DESCRIPTION OF THE DRAWINGS

The present disclosure may be better understood with reference to the following drawing figures and description.

Non-limiting and non-exhaustive descriptions are described with reference to the following drawing figures. The components in the figures are not necessarily to scale, emphasis instead being placed upon illustrating principles. In the figures, like referenced numerals may refer to like parts throughout the different figures unless otherwise specified. Further, because the disclosed fibers, tows and yarns (and their orientations) in practice are very small and closely packed, the figures herein may show exaggerated and/or idealized fiber width and spacing in order to more clearly illustrate the fiber orientations and shape of the bundles.

DETAILED DESCRIPTION

Figure 1:
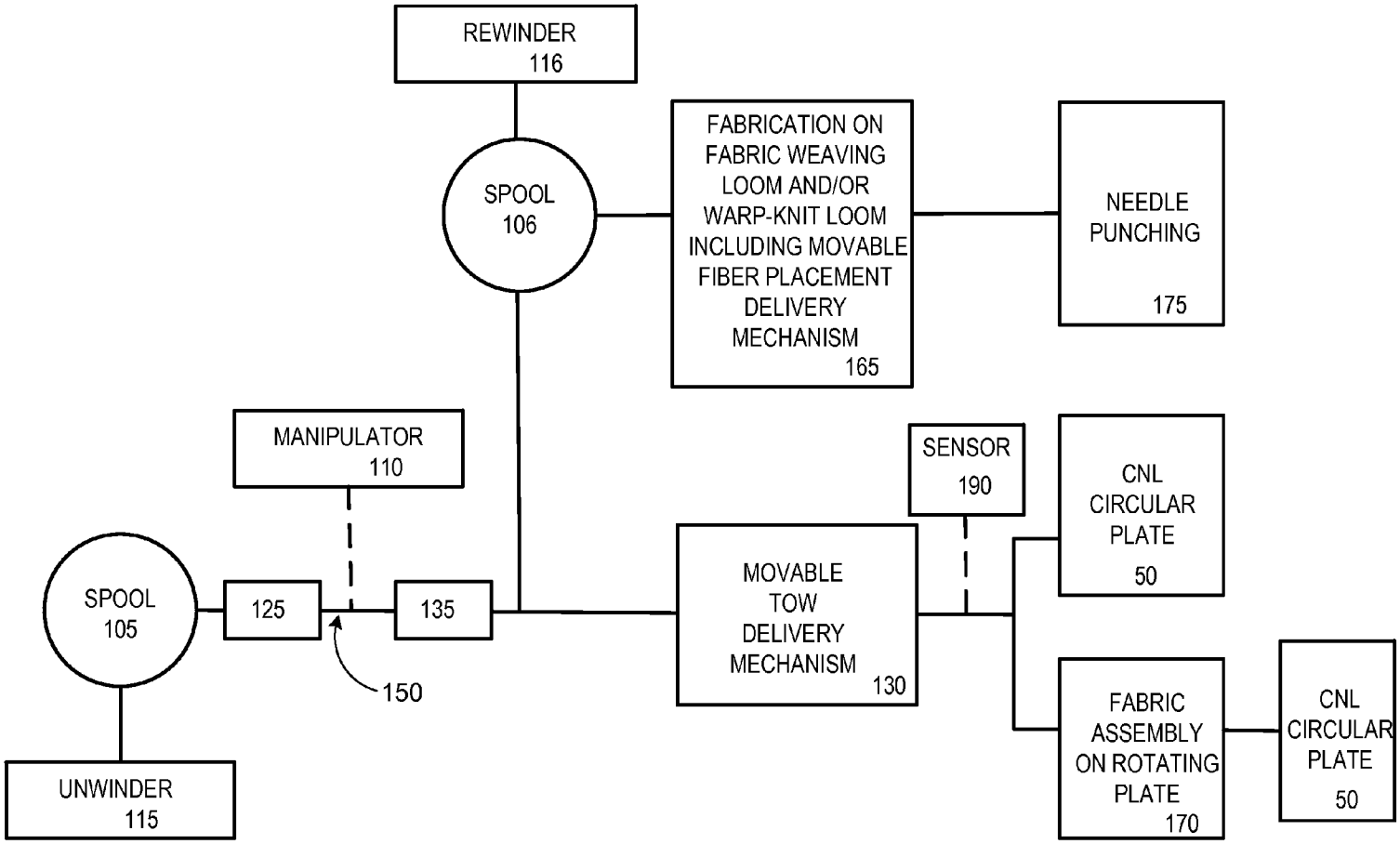
FIG. 1 illustrates methods and systems to fabricate textile with volumized tows according to various embodiments.

The detailed description of various embodiments herein makes reference to the accompanying drawing figures, which show various embodiments and implementations thereof by way of illustration and its best mode, and not of limitation. While these embodiments are described in sufficient detail to enable those skilled in the art to practice the embodiments, it should be understood that other embodiments may be realized and that logical and mechanical changes may be made without departing from the spirit and scope of the disclosure. Furthermore, any reference to singular includes plural embodiments, and any reference to more than one component or step may include a singular embodiment or step.

Also, any reference to attached, fixed, connected or the like may include permanent, removable, temporary, partial, full and/or any other possible attachment option. Additionally, any reference to without contact (or similar phrases) may also include reduced contact or minimal contact. Finally, though the various embodiments discussed herein may be carried out in the context of an aircraft, it should be understood that systems and methods disclosed herein may be incorporated into anything needing a brake or having a wheel, or into any vehicle such as, for example, an aircraft, a train, a bus, an automobile and the like.

This application relates to carbonized carbon fibers which may be assembled into a needled preforms. Two or more layers of fibers may be layered onto a support and are then needled together simultaneously or in a series of needling steps. This process interconnects the horizontal fibers with a third direction (also called the z-direction). The fibers extending into the third direction are also called z-fibers. This needling process may involve driving a multitude of barbed needles into the fibrous layers to displace a portion of the horizontal fibers into the z-direction. The matrix material being carbon, ceramic or a combination of carbon and ceramic.

As used herein, the terms "tow" and "cable" are used to refer to one or more strands of substantially continuous filaments. Thus, a "tow" or "cable" may refer to a plurality of strands of substantially continuous filaments or a single strand of substantially continuous filament. "Fiber bundle" may refer to a tow of substantially continuous filaments. "Spiral" fabric may also be referred to herein as "helical" fabric. A "textile" may be referred to as a "fabric" or a "tape." A "loom" may refer to any weaving device, such as a narrow fabric needle loom, a warm-knit loom, and/or weft knit loom.

As used herein, the term "ribbon" is used to refer to "as fabricated carbon fiber tows" with closely packed bundle of continuous filaments. The term "volumized carbon fiber tow" refers to carbon fiber tow manipulated with air. A spool may be a supply of a fiber bundle. A "span" as used herein may be a length of tow. As used herein, the term "yarn" is used to refer to a strand of substantially continuous fibers or staple fibers or blends of these, thus the term "yarn" encompasses tow and cable. As used herein, the unit "K" represents "thousand." Thus, a 1K tow means a tow comprising about 1,000 strands of substantially continuous filaments. For example, a "heavy tow" may comprise about 48,000 (48K) textile fibers in a single tow, whereas a "medium tow" may comprise about 24,000 (24K) textile fibers within a single tow whereas a "lighter tow" may comprise about 6,000 (6K) textile fibers within a single tow. Fewer or greater amounts of textile fibers may be used per cable in various embodiments. In various embodiments disclosed herein, fabrics in accordance with various embodiments may comprise tows of from about 0.1K to about 100K, and, in various embodiments, heavier tows. As is understood, "warp" fibers are fibers that lie in the "warp" direction in the textile, i.e., along the length of the textile. "Weft" fibers are fibers that lie in the "weft" direction in the textile, i.e., along the width of the textile. Traditionally weft describes tow oriented at 90 degrees from warp direction. For simplification, as used herein weft also describes any tow oriented at some angle with the warp (or circumferential fibers) such as bias fiber set a 45 degrees±15 with respect to the circumferential direction. Warp fibers may be described as being spaced apart with respect to the weft direction (i.e., spaced apart between the outer diameter (OD) and inner diameter (ID) of the textile). Similarly, the weft tows may be described as being spaced apart with respect to the warp direction.

In various embodiments, any combination of warp and weft tow size may be used. For example, 48K warp tows may be used with 24K weft tows. Also for example, other combinations of warp tows to weft tows include: 48K:12K, 24K:24K, and 24K:12K. As fabricated carbon fiber tow may be wrapped around a spool for ease of transport and feeding into a textile loom for fabricating a fabric which is used in a subsequent preforming process using needle punching. The as fabricated carbon fiber tow on the spool comprises a generally closed packed rectangular cross sectional shape. A length of as fabricated carbon fiber tows may be delivered from the spool to the textile loom. In response to being manipulated under tension by a textile loom, the generally rectangular shaped cross section of the as fabricated carbon fiber tow changes to a generally oval shaped cross section. This oval shaped cross section containing a high fiber volume is undesirable and a preferred approach is to spread the as fabricated carbon fiber tow in the Y direction (with brief reference to FIG. 4) to increase the width, W, of the ribbon to increase coverage and reduce fiber volume. The as fabricated carbon fiber tow may be spread mechanically through passage over and under specially shaped bars. In the alternative, the as fabricated carbon fiber tow may be spread via vacuum suction or through ultrasonic vibration. In various embodiments, it may be advantageous to provide bulk to the tow through the use of an air jet, thus re-orienting a portion of the fibers and providing greater volume to the tow and imparting some stability to the new tow configuration during further handling. Air jet manipulation may follow previous manipulation of the tow through means described earlier.

Fabrication of dry fabrics where the fiber tows retain their original flat as fabricated carbon fiber tows shape (and rectangular cross-sectional shape) or are further spread/volumized beyond their as-manufactured width (but maintain a rectangular cross-sectional shape) or are volumized is desirable for maximizing homogeneity of final fiber reinforced composites. The use of flat spread tows tends to minimize the amount of crimp in the manufactured fabrics and allows the fabrication of low areal weight fabric with full fiber coverage using larger tows such as about 12,000 filament tows to about 50,000 filament tows. Furthermore, in various applications, like the manufacturing of C/C or carbon/ceramic friction disks where the dry fabric may be subsequently transformed into a 3D fiber structure, such as through a needle punching/needling process, looser spread tows and/or volumized tows are more conducive to the fabrication of a textile preform with a homogeneous fiber distribution within each horizontal plane of the textile. The more homogeneous fiber distribution in the preforms results in turn in more homogeneous distribution of the matrix material.

As previously mentioned, commercial carbon fiber tows are typically packaged in the form of a flat as fabricated carbon fiber tow onto spools, such as cardboard spools. However, during handling under tension through the various components of a loom, the dry tows have a tendency to "neck down" or reduce in cross sectional area and take a rounded or oval shape, when viewed along a cross section. Fiber coverage of these fabrics at low areal weights is very poor. A preform needled with such a fabric made of tighter rounded tows exhibits more distinct tows of higher fiber volume separated by larger gaps. These high fiber volume fiber bundles separated by larger gaps results in poor coverage and layers with locally higher density in finished composite product.

During fabrication of annular preforms, such as those used in aircraft brake needled preforms, it is desirable, in addition to fiber orientations, to control the shape and the fiber volume of the carbon fiber tows during the various textile steps preceding the needle-punching step. Looser/bulkier spread tows are more conducive to the fabrication of a textile brake preform exhibiting a homogeneous fiber distribution within each horizontal plane of the textile. Furthermore, the use of flat spread tows allows the fabrication of low areal weight fabrics with full fiber coverage using larger tows such as 12K to 50K tows. Potential feed textiles to fabricate annular needled preforms such as continuous helical fabrics are typically fabricated using take-off systems to pull the fabric and tows through the weaving loom. This approach imparts tension on the as fabricated carbon fiber tows and forces the bundle of tows from their original as fabricated carbon fiber tows shapes into rounded, packed tows having a generally circular and/or oblong cross-section. These fabrics with localized high fiber volume fiber bundles require a high level of needling to fabricate a carbon preform with a low fiber volume, such as for the manufacturing of carbon-carbon friction disks. One efficient approach to fabricate an annular needled preform is to directly introduce part or all the fibers in the form of tows fed directly to the needle punching loom. Approaches to directly feed carbon fiber tows into a circular needle punching loom are described in U.S. Pat. No. 7,185,404 which is hereby incorporated by reference. The described approaches may have limitations in both degree of control of the fiber orientations and the spread of tows. In this situation, limited spreading of the tows is conducted to achieve coverage along outer circumference of fiber sectors. According to various embodiments, and with reference to FIG. 1, a device may be utilized to deliver a substantially continuous feed of a length of fiber bundle 150 to be rewound, such as via a rewinder 116, on a second spool 106 delivered to a needling apparatus, such as a circular needle loom 50, also known as a circular needle punching loom, and/or delivered to a lay down surface, such as a circular loom bed plate turntable 200.

According to various embodiments, the device may be a device configured to impart little to no tension on the fiber bundle 150 as the fiber bundle 150 is delivered from an as fabricated carbon fiber tow supply, such as a spool 105, to the circular needle loom 50, circular loom bed plate turntable 200, or a secondary spool 106, (e.g., re-spooling). According to various embodiments, the device comprises an unwinder 115 configured to maintain constant adjustable minimum tension on the tow as the tow is positively driven with tow delivery mechanism 130 placed between a delivery location and the spool 105. A sensor 190 measuring linear speed of the tow within the delivery mechanism communicates with the unwinder. The tension between the unwinder and the tow delivery mechanism is low. Stated another way, the tension between the tow delivery mechanism and the tow placement surface is extremely low as delivery mechanism 130 pushes the tow forward toward the lay down location such as a CNL 50 and/or a fabric assembly process on a rotating plate 170, with brief reference to FIG. 1. The fabric assembly process on a rotating plate 170 may be a precursor to delivery of the tow to a CNL 50.

The tow delivery mechanism 130 may comprise pinch rollers with a motor driving at least one of the rollers. Each tow delivery mechanism may transport one or several tows. The spatial location of the tow delivery system above the circular loom bed plate turntable 200 may be automatically adjusted to achieve targeted fiber orientation within the preform.

In their preform state, fiber reinforced composites prepared with carbon fiber tows or ceramic fiber tows typically exhibit a wide range of porosity including very small pores. Finer porosity is generally not readily accessible. The wide range of porosity frequently translates in heterogeneous densification of the resultant composites. As received carbon or ceramic fiber tows exhibit very high fiber volume with short fiber to fiber distances. Packing of the fibers within the tow may be maintained during the typical textile operations which precede the preforming step such as weaving and fiber placement.

During the textile process, usually done under tension, re-arrangement of the as fabricated carbon fiber tow into a thicker more rounded shape further results in non-uniform distribution of the fiber in a resultant composite. In the case of preforming using needle-punching the heterogeneous fiber, distribution is generally not improved by the action of the barbed needles. In various embodiments, increased fiber to fiber distance within the tow is achieved using a manipulator 110, such as a high velocity air flow.

According to various embodiments, and with reference back to FIG. 1, between the as fabricated carbon fiber tow supply A that includes spool 105, and the delivery location, a manipulator 110 may be interposed. The manipulator 110 may assist with achieving the fiber volume and/or areal weight desired. The manipulator 110 may agitate, disturb, loosen, volumize and/or spread the fiber bundle 150 into a desired fiber volume. The manipulator 110 may be a physical apparatus, such as a spreader bar. The manipulator 110 may be jets of gas, such as compressed air via a compressed air feed 117, configured to disturb the orientation of the fibers within the fiber bundle 150. The manipulator 110 may be an ultrasonic device configured to utilize an ultrasonic process to disrupt the orientation of fibers of the fiber bundle 150. The manipulator 110 may be a combination of mechanical spreading and air manipulation. A chute 155 may be interposed between the tow delivery mechanism 130 and the circular loom bed plate turntable 200. The chute 155 may take the form of a chamber where additional manipulation of the tow may be conducted. For example, compressed air may be used to manipulate the tow instead of at location of manipulator 110 or in addition to location of manipulator 110. The chute 155 may take the form of a slide or chamber which function is to guide fiber bundle 150 to final lay-up condition.

Yarn texturization typically results in extreme fiber reorganization with formation of multiple loops and sometimes yarn twisting. The present disclosure describes a system configured to utilize high velocity air to increase the distance fiber to fiber within the tow (see FIGS. 5A and 5B), provide a limited amount of off-axis fiber re-orientation to maintain the volume of the tow during further handling while minimizing fiber damage and tow twisting. As used herein the term "tow volumizing" will be used through the remainder of this disclosure to describe intended manipulation of the tow. Two general approaches may be used for achieving desired tow configuration for enabling the fabrication of a carbon or ceramic fiber preform with a more uniform fiber distribution and facilitating homogeneous introduction of the matrix. A preferred first approach is to allow more access to the fibers within the tow to condition the fibers within the tow prior to fabrication of the textile. A second approach is to manipulate the tows following textile preparation.

Figure 4:
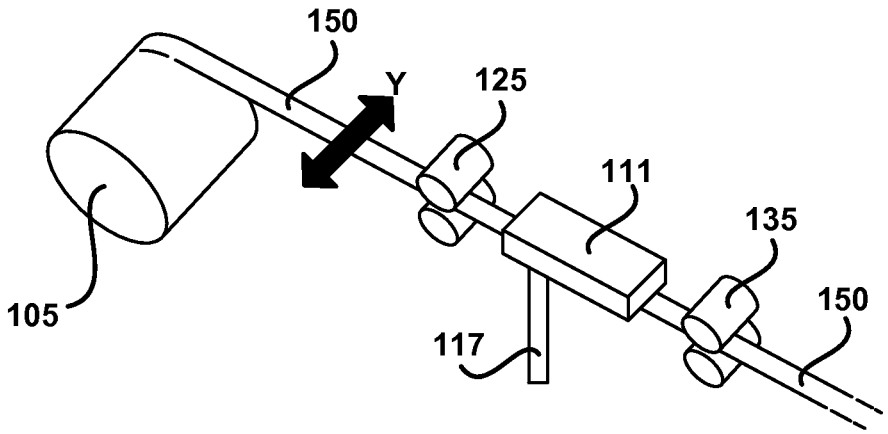
FIG. 4 illustrates a manipulator interposed between a spool and a delivery location according to various embodiments.

According to various embodiments, FIG. 4 depicts an example of a set-up for volumizing a fiber bundle 150. The fiber bundle 150 is pulled from its original spool 105 without imparting twist, manipulated with a manipulator, such as an air jet device 111 and fed towards online textile forming process. In various embodiments, the fiber bundle 150, following manipulation, is re-packaged for preparing textile on a separate station/spool. It is desirable to create some amount of fiber bundle 150 overfeed inside the air jet device 111 to allow the fibers of the fiber bundle 150 to be in a relaxed state and react to air flow. Stated another way, slack is achieved on the length of tow inside the air jet device 111. This overfed condition, (e.g., where a portion of the fiber bundle comprises slack and/or very low tension may be achieved by positive feed pinch rollers disposed on either side of the tow around the air jet device 111. For instance, as depicted in FIG. 4, a first assembly 125, such as a positive feed pinch roller assembly and/or first moveable positive fiber bundle delivery mechanism may flank the entrance to the air jet device 111 and be configured to insert the fiber bundle 150 into the air jet device 111. A second assembly 135, such as a positive feed pinch roller assembly and/or a second moveable positive fiber bundle delivery mechanism, may push the fiber bundle 150 to exit the air jet device 111. The operation of assemblies 125 and 135 may be synchronized and/or operated by a controller. The air jet device 111 comprises one or several air feeding channels oriented at selected angles with the transport direction of the fiber bundle 150. The geometry of the feed channel creates a turbulent high velocity air stream which is used to manipulate the fibers within the fiber bundle 150.

Though they may be made from any desirable material, the air jet device 111 may comprise wear resistant ceramics. The air fed to the air jet device 111 may be regulated to be between 5 psi to 100 psi (34.5 kPa to 689.5 kPa). The degree of fiber bundle 150 fiber manipulation may be determined by type of device used (number, geometry and orientation of air feeds), air velocity, fiber bundle 150 speed, fiber bundle 150 tension, characteristics of fiber, and/or the amount of sizing. Pre-conditioning of the fiber bundle 150 prior to entering the air jet device 111 such as spreading the fiber bundle 150 using known devices such as "banana bars", ultrasound energy or other techniques may be advantageously conducted to minimize amount of force expanded in air jet device 111.

Figure 5A:
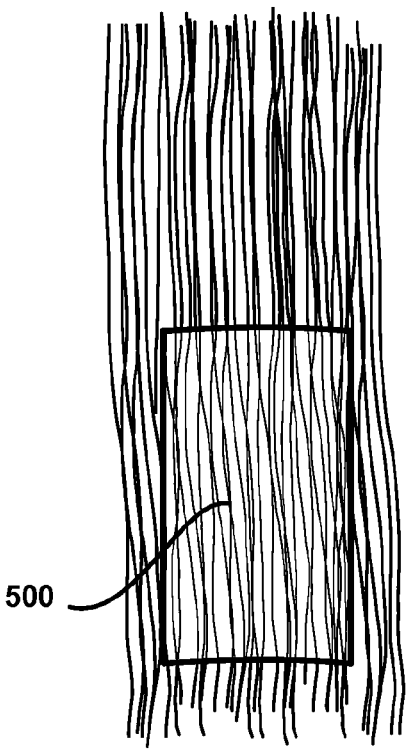
FIG. 5A depicts as received carbon fiber 12K tows and volumized carbon fiber 12K tows according to the state of the art.
Figure 5B:
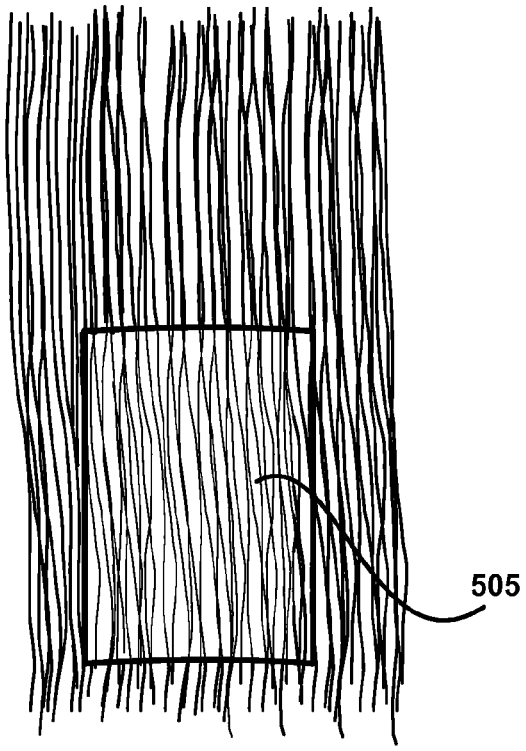
FIG. 5B depicts volumized 24K carbon fiber tows and as received carbon fiber 24K tows according to various embodiments.

According to various embodiments, FIGS. 5A and 5B depict as received carbon fiber tows 500 and volumized carbon fiber tows 505, such as 12K and 24K carbon fiber tows. One targeted application is the fabrication of carbon/carbon composites for friction applications. Obtaining uniform distribution of fiber and chemical vapor infiltration (CVI) pyrolytic carbon in the final composite may be desirable in these applications. Alternatively, a ceramic matrix or partial ceramic matrix may be introduced using CVI, powder, liquid infiltration or silicon melt infiltration.

Carbon/carbon composites prepared with carbonized carbon fiber tows for other high temperature applications like propulsion components are also potential candidates for the technology. Tight fiber bundles may result in poor inter-fiber gas diffusion. This results in high hardness regions within the material. Following the fiber bundle 150 volumizing step, for example 12K and 24K tows, a fabric may be fabricated using one of several processes including weaving, such as via a fabric weaving loom, multi-axial warp knitting, via a warp-knit loom, 165 or some form of fiber placement mechanism 165, such as those described with respect to FIGS. 2 and 3. The volumized fiber bundle 150 may undergo a needle punching step 175. With continued reference to FIG. 1, a volumized fiber bundle 150 may be prepared separately from a CNL circular plate 50 laydown process. For instance, respooled volumized fiber bundle 150, such as via a rewinder 116, may be fed to a movable positive delivery mechanism as part of a fabrication system 165. The fabrication system 165 may deliver volumized tows to a fabric weaving loom and/or a warp-knit loom prior to a needle punching step 175. A volumized fiber bundle 150 which include off axis fibers have a low propensity in necking down under tension as described herein.

A net shape preform may be subsequently fabricated using needle-punching. The volumized fiber bundle 150 may advantageously occupy a greater volume with more relaxed fibers. Less energy may be expended to reach a lower fiber volume. Z fiber transport may be facilitated by the fibers in a more relaxed state. A more uniform densification results from the use of the volumized fiber bundle 150. Handling of the volumized fiber bundle 150 under minimum tension during preparation of the textile and preform is desirable for maintaining the features imparted to the tow during the volumization step. Other high temperature composites such as carbon fiber reinforced with a silicon carbide CVI matrix are also candidates for this technology. Carbon fiber tow size may range from 1K to 100K. A second set of targeted applications are ceramic composites fabricated with high temperature fibers such as SiC and $Al_2O_3$. Such composites may be densified using chemical vapor infiltration, preceramic polymers or sol gel infiltration processes. Ceramic fiber tows are generally smaller (0.5K to 2.5K) than carbon fiber tows but gas diffusion path and limitation of material transport in limited space between fibers remain obstacles for achieving a well densified material. Insufficient densification inter-fibers may have negative impact on composite mechanical properties and degradation of material under atmosphere found in gas turbine engine components. Opening-up of the fiber bundles may also be beneficial for introducing ceramic powders within the inter-fiber spaces as it is frequently done with pre-ceramic and sol gel densification approaches. Air volumizing parameters may be tailored to minimize strong fiber reorientation and fiber damage in these highly mechanically and thermally loaded high temperature applications.

Figure 6:
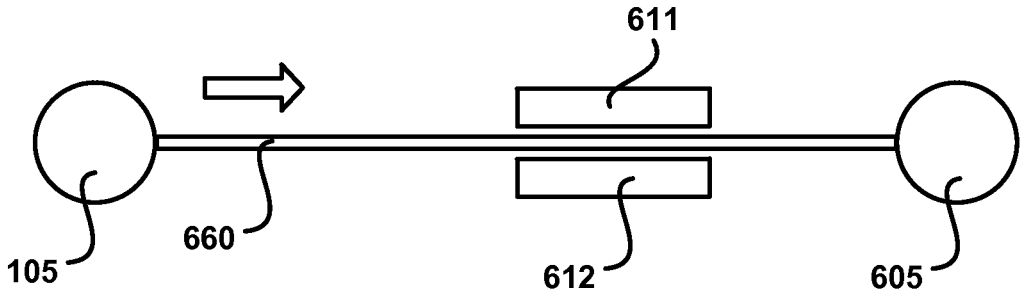
FIG. 6 illustrates a pair of manipulators interposed between a spool and a delivery location, such as a spool, according to various embodiments.

According to various embodiments and with reference to FIG. 6, the fabric 660 may be prepared with as-received tows and the fabric is subsequently manipulated with multiple air jets, 611, and 612. This may be achieved using fabrics 660 with low inter-locking to facilitate action of air jets 611, 612. For example, looser open weave architectures of fabrics 660, such as twills, may be preferable as compared to tight plain weave architectures. Un-crimped stitch bonded multi-axial fabrics with low stitch line counts are also better suited for post fabric preparation air treatment. Air treatment may be performed using air jets 611, 612 positioned on both sides, (e.g., top and bottom surface) of the fabric 660 as shown in FIG. 6. Depending of the geometry of the textile the air module may take different forms. FIG. 6 depicts a first spool 105 to second spool 605 straight fabric 660 fed between two air jets 611, 612. In each module air may be accelerated using multiple rows of nozzle or a limited number of slots running across the width of the fabric 660.

In general, the composite industry fabricates components from as received fiber tows which exhibit very high fiber volume and small fiber to fiber distance. As received fiber tows may enter and/or undergo densification. Utilizing accelerated air to volumize fiber tows to increase fiber to fiber spacing provides a mechanism to facilitate densification of fiber reinforced carbon or ceramic composites. Treatment of the tow results in more homogeneous better densified composites. In a friction material where uniform wear is desirable, uniform material hardness is also pursued. In demanding ceramic composite applications such as gas turbine engine components where material is subjected to high mechanical, thermal and fatigue loads, it is important to surround the fibers with as uniform a matrix as possible.

Figure 2:
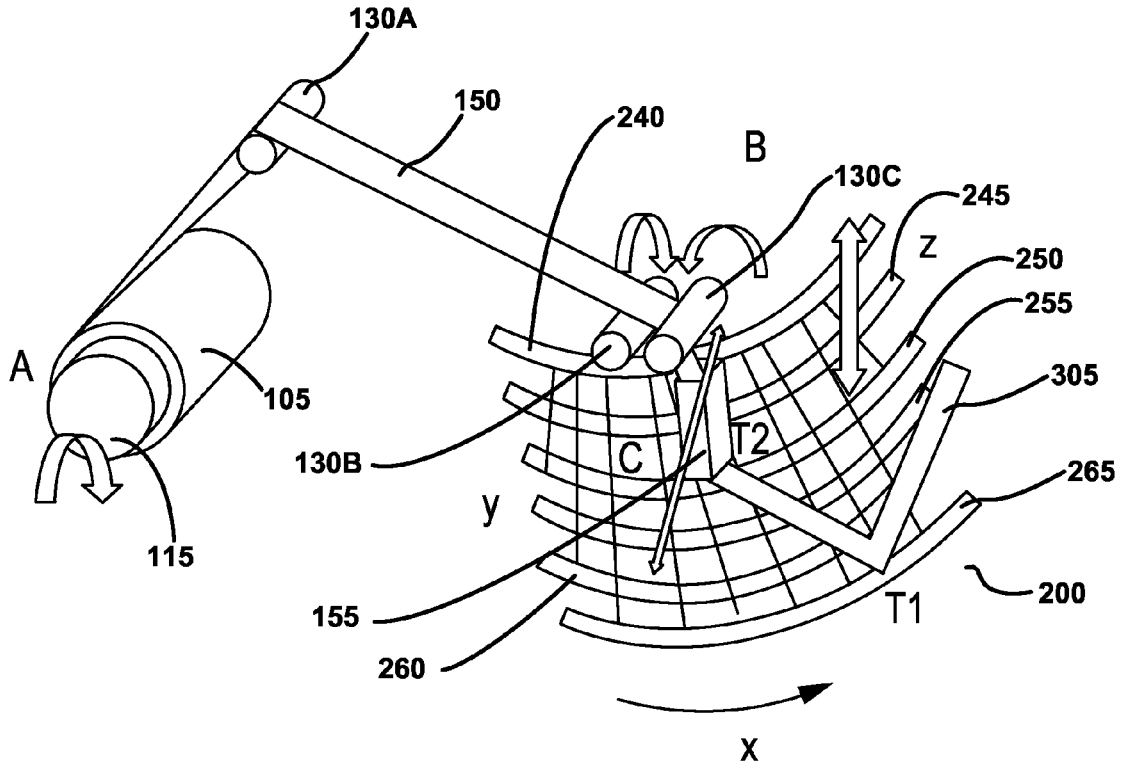
FIG. 2 illustrates a top view of a circular needle loom configured to receive the transport layer securing mechanism according to various embodiments related to a stationary bed plate.

With reference to FIG. 2, a pre-woven unidirectional helical fabric with circumferential orientation of volumized fiber tows 245, 250, 255, 265 prepared, for example on a narrow fabric needle loom, is first laid down on the bed plate of the circular needle loom 50. Moveable tow delivery assembly B+C comprising two positive tow delivery mechanisms 130B, 130C and chute 155 may be positioned at a selected angle with the general rotational direction X of the turntable. The tow delivery assembly is automatically moved in the Y direction and volumized tow sections T1, T2 is deposited on the unidirectional (UD) fabric. For instance, the V shaped pattern 305 of fiber bundles is achieved by the coordination of the movement of tow delivery assembly B+C along the Y direction with the rotational movement of circular loom bed plate turntable 200 in either direction clockwise or counter-clockwise.

Figure 3:
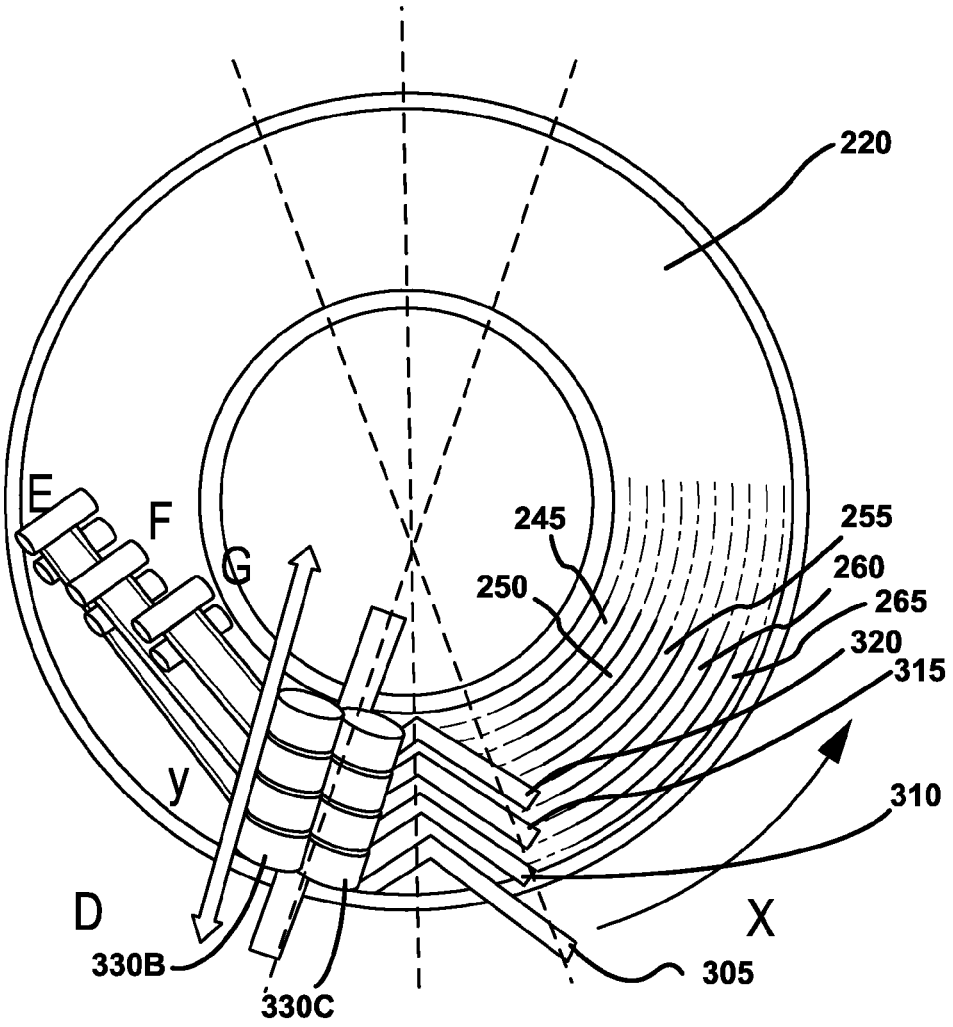
FIG. 3 illustrates a circular needle loom configured to receive the transport layer securing mechanism according to various embodiments.

In various embodiments, with reference to FIG. 3. multiple fiber bundle layers may be simultaneously laid down on circular loom bed plate turntable 200. A plurality of stationary tow delivery systems E, F, G supporting conical pinch rollers may be used to lay down circumferential volumized fiber bundles 240, 245, 250, 255, 260, 265 (See also FIG. 2). Each set of positive tow delivery mechanisms 130 may deliver one or several fiber bundles. Speed of tow bundle delivery is coordinated with rotational speed of turntable. Pattern 305 is achieved through the entire width of bed plate by coordinating movement of a plate 220 of the circular loom bed plate turntable 200 with movement along Y of a plurality of tow delivery mechanisms mounted on a common support. In this way very, high fiber bundle placement speed may be achieved.

For instance, with brief reference to FIG. 3, plate 220 of the circular loom bed plate turntable 200 may work in coordinated movement with a the plurality of fiber bundle 150 feeders, such as tow delivery mechanisms 330B and 330C in close proximity. Mechanism 330 lays down the bias volumized tows. The fixed tow delivery systems E, F and G lay down the circumferential volumized tows.

According to various embodiments with reference to FIG. 4, as fiber bundle 150, is received in as fabricated carbon fiber tow form, with in-line manipulation of the fiber bundles 150 (spreading or spreading and volumization with manipulators 110) during their transport to points of delivery into the circular loom bed plate turntable 200, positive transport is achieved. The automated placement of these points of deliveries to lay down the fiber bundles 150 at selected orientations in the area correspond to the feeding zone of the circular loom bed plate turntable 200.

Control of the fiber bundle 150 transport is accomplished by using positive tow delivery mechanism 130. The positive tow delivery mechanism 130 may be a "feed device" configured to direct the path of the fiber bundle. Positive tow delivery mechanism 130 may be any shape; however, in accordance with various embodiments the tow delivery mechanism 130 may be cylindrical and/or conical and the assembly is moveable to selected positions at selected speeds. The positive tow delivery mechanism 130 may communicate with an electronic unwinder 115 that allows the un-winding and transport of fiber bundle 150 under minimum controlled tension. Spreading and bulking of a fiber bundle 150 may be conducted using a manipulator 110, such as a by using specially curved shaped bars or/and air jets and/or ultrasonic energy and/or a combination of the above methods.

This method may be used to lay down a desired preform fiber orientation directly on the circular needle punching loom, such as on a circular loom bed plate turntable 200. This method may be practiced to lay down selected fiber orientations for all the layers of the preforms or to lay down portions of the layers onto a supporting pre-woven helical fabric simultaneously fed to the circular needle-punching loom. According to various embodiments, with reference to FIGS. 2 and 3, arrangement of a plurality of transport/feeding sub-systems on a common mechanized axis Y enables, in particular, the rapid application of multiple volumized fiber bundles 150 at once. Using an unwinder 115 with controlled low tension allows using miniature servomotors to positively drive the fiber bundle 150 and fit the feeding subsystem into a small envelop, which is a helpful feature when fiber bundles 150 are being fed directly to the circular needle loom 50. In this way, unwinder 115 with servomotors may positively drive the fiber bundle 150 with extra slack such that little to no tension is applied to the fiber bundle 150 such that it may retain its as fabricated carbon fiber tow rectangular cross-sectional shape or modified imparted shape through suitable manipulation.

According to various embodiments, a transport mechanism may comprise a positively fed fiber bundle 150 using an unwinder 115 unit with automated tension control and carbon fiber spool 105, positive tow delivery mechanism 130 driven by servomotors to assist with positively feeding fiber bundle 150, a fiber bundle feeding chute 155, coordinated X and Y movements to lay down fiber bundles 150 at selected angles satisfying unique circular geometry of a targeted annular shaped textile. The fiber bundle 150 may be fed to the feeding chute 155 under controlled minimum tension, using the servomotors and positive tow delivery mechanism 130 as positive fiber bundle 150 drives. The tension of the fiber bundle 150 between the spool 105 and the positive tow delivery mechanism 130 may be controlled by an electronic unwinder 115 and a speed sensor. This mode of transport delivers a flat fiber bundle 150 to the feeding chute 155. A fiber bundle 150 may be laid-down according to the selected fiber lay down pattern by coordinating the movements of the circular loom bed plate turntable 200 and the Y movement of the chute 155 fiber bundle 150 delivery assembly. Circumferential fiber orientation may be achieved (with brief reference to FIG. 3). Other orientations such as pure radial orientation may also be achieved. In various embodiments, air jets may be installed in between the spool and tow delivery system or in the feeding chute 155 to bulk the fiber bundle 150 and reduce its fiber volume. Fiber bundle 150 may be delivered/applied with a small amount of tension or with some slack by controlling the circumferential speed of the tow delivery mechanism 130 and the speed of the X, Y movements of the circular loom bed plate turntable 200.

According to various embodiments, a process to manufacture, at high speed, a net shape preform, such as an annulus, with circumferential fibers and fibers oriented at selected angles from the annular preform radial directions may begin with fabrication of a continuous helical shape fabric using carbon fiber bundles 150 in the circumferential direction and a synthetic yarn in the fill direction. This continuous fabric is then fed to the bed plate of a circular loom bed plate turntable 200. A fiber bundle feeder's assembly is used to continuously and simultaneously lay down multiple fiber bundles in the form of a V pattern on top of the unidirectional fabric. This approach allows taking advantage of various methodologies put forward in U.S. Patent Application Publication No. 2011/0275266, entitled "System and Method for Textile Positioning," filed on May 5, 2010 and incorporated herein by reference. For example, transport of the fabric and of the preform being built on a smooth bed plate is realized by the inner and outer edges of the fabric, such as the unidirectional helical carbon fabric. A spool of unidirectional helical carbon fabric wound on a conical mandrel as shown in the '266 Publication is unwound on the bed plate of a circular needle loom 50. An assembly of several motorized feeders is used to lay down the fiber bundles 150 across the width of the fabric in a single movement. The geometrical definition of the adjacent Vs (segment length and angles with radial directions) may be achieved by coordinating the rotational movement of the circular loom bed plate turntable 200 and of the radial movement Y of the feeder's assembly. A moveable horizontal bar oriented in the radial direction or sets of wheels may be used to keep the V segments flat and in position.

According to various embodiments, subsystems to achieve the desired lay down pattern may include a plurality of cylindrical nip or conical pinch rollers applying pressure on the fiber bundle 150 to drive it. Each tow delivery mechanism 130, which may be cylindrical or conical, may be driven by its own miniature servomotor. Alternatively, only one of each set of rollers is motorized and the drive of the fiber bundle 150 is accomplished by using a second spring loaded conical roller or a system where the roller is mechanically pushed into position. A suitable orientation for the rollers is mounting the rollers horizontally above the feeding chute 155.

As noted above, existing reels, spools and other mechanisms may be used for storing and deploying spiral wound textiles, fiber bundles and/or carbon fiber tows. Although this disclosure illustrates and describes various embodiments, equivalents and modifications will occur to others who are skilled in the art upon reading and understanding of the disclosure.

Additionally, benefits, other advantages, and solutions to problems have been described herein with regard to various embodiments. However, the benefits, advantages, solutions to problems, and any elements that may cause any benefit, advantage, or solution to occur or become more pronounced are not to be construed as critical, required, or essential features or elements of the invention. The scope of the invention is accordingly to be limited by nothing other than the appended claims, in which reference to an element in the singular is not intended to mean "one and only one" unless explicitly so stated, but rather "one or more." Moreover, where a phrase similar to "at least one of A, B, and C" or "at least one of A, B, or C" is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

As used herein, the singular forms "a," "an," and "the" include plural referents unless the context clearly dictates otherwise. As used herein, the terms "for example," "for instance," "such as," or "including" are meant to introduce examples that further clarify more general subject matter. Unless otherwise specified, these examples are embodiments of the present disclosure, and are not meant to be limiting in any fashion.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A textile fabrication system comprising:

a supply of a fiber bundle, wherein the fiber bundle comprises at least one of a fiber entering a carbon/carbon or a ceramic composite;

an air jet device coupled between the supply of the fiber bundle and a lay down location, wherein the air jet device is configured to alter at least one of a fiber volume or an areal weight of the fiber bundle, wherein the air jet device is configured to form a length of volumized fiber bundle, wherein a textile is fabricated from the length of volumized fiber bundle via a fabrication process at the lay down location, wherein the fabrication process comprises at least one of a fabric weaving loom, a multi-axial warp knitting apparatus, or a positive delivery fiber placement fabrication process;

a first moveable positive fiber bundle delivery mechanism coupled between the air jet device and the supply of the fiber bundle; and a second moveable positive fiber bundle delivery mechanism coupled between the air jet device and the lay down location, wherein the first movable positive fiber bundle delivery mechanism is configured to insert the fiber bundle into the air jet device, and the second movable positive fiber bundle delivery mechanism is configured to push the fiber bundle to exit the air jet device, and wherein the fiber bundle is in an overfed state while being manipulated by the air jet device.

2. The textile fabrication system of claim 1, further comprising an electronic unwinder coupled to the supply of the fiber bundle, wherein the electronic unwinder is configured to interact with the first moveable positive fiber bundle delivery mechanism.

3. The textile fabrication system of claim 2, further comprising a speed sensor coupled to the first moveable positive fiber bundle delivery mechanism, wherein the sensor is configured to measure a linear speed of the fiber bundle and control operation of the electronic unwinder.

4. The textile fabrication system of claim 1, further comprising needling the textile.

5. The textile fabrication system of claim 1, wherein the lay down location comprises at least one of a re-spooling of the fiber bundle, a moving surface for assembling fiber bundles into fabric or a circular loom bed plate turntable.

6. The textile fabrication system of claim 1, wherein the air jet device is configured to utilize accelerated air to volumize tows within the fiber bundle to increase fiber to fiber spacing and to facilitate densification of fiber reinforced carbon or ceramic composites created from the length of volumized fiber bundle.

7. The textile fabrication system of claim 2, wherein positive delivery via the first moveable positive fiber bundle delivery mechanism comprises pushing the length of volumized fiber bundle to the lay down location while imparting at least one of little or no tension on the length of volumized fiber bundle.

8. The textile fabrication system of claim 1, wherein a compressed air feed is coupled to the air jet device.

9. The textile fabrication system of claim 1, wherein the air jet device comprises at least one air feeding channel oriented at a selected angle in a transport direction of the fiber bundle.

10. The textile fabrication system of claim 6, wherein the air jet device is configured to apply accelerated air to a first side and a second side of the fiber bundle.

11. A method of fabricating a textile comprising:

transporting a fiber bundle from a fiber bundle supply to a lay down location, wherein the fiber bundle comprises at least one of a fiber entering a carbon/carbon or a ceramic composite;

altering at least one of a fiber volume or an areal weight of the fiber bundle via an air jet device coupled between the fiber bundle supply and the lay down location, imparting an overfed condition on the fiber bundle during the altering via the air jet device by a first moveable positive fiber bundle delivery mechanism coupled between the air jet device and the fiber bundle supply inserting the fiber bundle into the air jet device and a second moveable positive fiber bundle delivery mechanism coupled between the air jet device and the lay down location pushing the fiber bundle to exit the air jet device;

forming a length of volumized fiber bundle via the altering; and fabricating the textile from the length of volumized fiber bundle via a fabrication process at the lay down location, wherein the fabrication process comprises at least one of a fabric weaving, multi-axial warp knitting, or a positive delivery fiber placement fabrication process.

12. The method of fabricating a textile of claim 11, further comprising needling the textile.

13. The method of fabricating a textile of claim 11, wherein the lay down location comprises at least one of a moving surface for assembling fiber bundles into a fabric or a circular loom bed plate turntable.

14. The method of fabricating a textile of claim 11, further comprising applying accelerated air via the air jet device to the fiber bundle from a first side and a second side of the fiber bundle.

* * * * *